United States Patent [19]

Kowalchuk

[11] Patent Number: 4,682,431

[45] Date of Patent: Jul. 28, 1987

[54] HOSPITAL ARM BAND

[75] Inventor: William M. Kowalchuk, Downsview, Canada

[73] Assignee: Moore Business Forms, Inc., Grand Island, N.Y.

[21] Appl. No.: 737,087

[22] Filed: May 23, 1985

[30] Foreign Application Priority Data

Jun. 13, 1984 [CA] Canada ..... 456435

[51] Int. Cl.[4] ..... G09F 3/14

[52] U.S. Cl. ..... 40/21 C

[58] Field of Search ..... 40/21 C, 21 R, 21 A, 40/304, 2 R; 24/17 B, 17 AP

[56] References Cited

U.S. PATENT DOCUMENTS

| | | | |
|---|---|---|---|
| 1,755,128 | 4/1930 | Peters | 40/2 R |
| 1,824,199 | 9/1931 | Donohoe | 40/21 R |
| 3,153,869 | 10/1964 | Twentier | 40/21 C |
| 3,656,247 | 4/1972 | Bushnell et al. | 40/21 C |
| 3,946,507 | 3/1976 | Fergg et al. | 40/2 R |
| 3,993,814 | 11/1976 | Cavender | 40/2 R |
| 4,078,324 | 3/1978 | Wiebe | 40/21 C |
| 4,311,740 | 1/1982 | Kay | 40/21 C |
| 4,318,234 | 3/1982 | Charles et al. | 40/21 C |

FOREIGN PATENT DOCUMENTS

| | | | |
|---|---|---|---|
| 0071933 | 2/1983 | European Pat. Off. | 40/2 R |
| 2308153 | 11/1976 | France | 40/21 C |

*Primary Examiner*—Robert P. Swiatek
*Assistant Examiner*—Cary E. Stone
*Attorney, Agent, or Firm*—Cushman, Darby & Cushman

[57] ABSTRACT

An identification band, particularly suited for use in hospitals or the like, comprises a single elongated strip of non-irritating material having an adhesive coating on one surface, and being adapted to receive data on the opposite surface. The strip is foldable about a centrally disposed longitudinal axis and, on one side of the axis is separable into a relatively short tab component at one end, and a relatively long body component extending to the other end, so that the body component may be folded about the axis to bring its adhesive surface into contact with the adhesive surface on the opposite side of the axis to form a relatively thin band component, the free end of which may be brought into overlapping relationship with the adhesive surface opposite the tab portion, with the tab portion then being bent over to bring its adhesive surface against the free end of the band portion in order to complete a circular band.

9 Claims, 5 Drawing Figures

HOSPITAL ARM BAND

BACKGROUND OF THE INVENTION

1. Field of the Invention

This invention relates to identification bands of the type which may be applied around the wrist or the ankle of a person, and to blanks for producing such bands. More particularly, the invention relates to identification bands suitable for use in hospitals or the like, the bands being applied to a patient upon admission to the hospital or like institution, and being worn for the duration of the patient's stay.

2. Description of the Related Art

The application of identification bands to the limbs of hospital patients is well known. The use of such bands is important to ensure that patients who are unconscious, or who are under sedation, or asleep, for example, can be properly identified in order to ensure that correct treatment and medication is given in such circumstances. Such bands may also be applied to new-borne babies for identification purposes.

Owing to the importance of such identification bands, the prior art bands have tended to be rather complex in structure in order to ensure that they are not easily removed, either accidentally or on purpose. As identification bands are generally formed of elongated strips of material whose free ends are joined together to produce a closed loop to encircle the wrist or ankle of a patient, the prior art bands have tended to comprise a complex arrangement of layers of material designed to resist tearing. Thus many of the known identification bands comprise a complex arrangement of overlapping layers of bonded material at the junction between the free ends of the strip of which the band is composed. Alternately, a single strip of material having adequate strength has been formed into a loop by the use of a metallic or similar clip which joins overlapping free ends, and which is normally applied by means of a special tool.

Apart from possible discomfort to the wearer of such prior art identification bands, and the complexity of their construction, one of the principal disadvantages of such bands is that they must be stored separately from conventional hospital admission forms, and consequently, identifying data applied to such bands must be applied in a step separate from the completion of the hospital admission form. In other words, it is normally necessary to first complete a hospital admission form in all applicable respects, then obtain a blank identification band, apply the relevant identifying data thereto, and subsequently apply the band to the patient. This inevitably involves some wastage of time in an area of the hospital where activity is particularly hectic and where there is frequently a need for speed and efficiency to ensure that patients are treated with all due dispatch. However, the principal concern is that the data on the identification band may not coincide with the information on the admission form where the two are completed separately. The data applied to the identification band may in fact be taken from the wrong admission form.

SUMMARY OF THE INVENTION

It is therefore an object of the present invention to provide an identification band, or more particularly a blank therefor, which may be retained directly on a hospital admission form or the like, and completed with relevant data at the time the admission form is completed.

It is a further object to provide such identification band blank which can readily be removed from the admission form upon its completion, and applied securely to the wrist or limb of a patient, with all relevant data legibly applied thereto, and without the need to employ any special tools or equipment.

Accordingly, in a broad aspect, the invention resides in an identification band blank which comprises an elongated strip of suitable material having a centrally disposed longitudinal axis about which the strip may be folded. One surface of the strip is covered with a pressure sensitive adhesive, whereas the other surface of the strip is adapted to receive data. The portion of the strip on one side of the longitudinal axis is separable, preferably by means of a through slit extending from the edge of the strip to the longitudinal axis, into a relatively short tab portion adjacent one end of the strip, and a relatively long body portion extending to the other end of the strip. Data may then be entered on one side of the longitudinal axis, whereupon the body portion may be folded about the longitudinal axis to bring the adhesive surfaces on either side of the longitudinal axis into contact to form a single elongated band portion. Thereafter, the free end of that band portion may be brought into overlapping relationship with the adhesive surface opposite said tab portion and adhered thereto, with the tab portion being folded over to bring its adhesive surface against the other side of the overlapping band to secure the two ends of the strip together to form a complete identification band in the form of a single loop which is normally applied about the limb of a patient in such a manner that any data applied to the identification band is clearly visible when the band is in encircling relationship to a patient's limb.

Such a band blank, being composed of but a single strip of material, can be removably applied to a hospital admission form or the like, and can have the relevant patient's data applied thereto at the same time the hospital admission form is being completed. Upon completion of the admission form, the blank may be quickly removed from the form and formed into an identification band about the limb of a patient simply, quickly and without the need to employ any special tools or equipment.

BRIEF DESCRIPTION OF THE DRAWINGS

In drawings which illustrate an embodiment of the invention.

DETAILED DESCRIPTION OF THE PREFERRED EMBODIMENT

Figure 1:
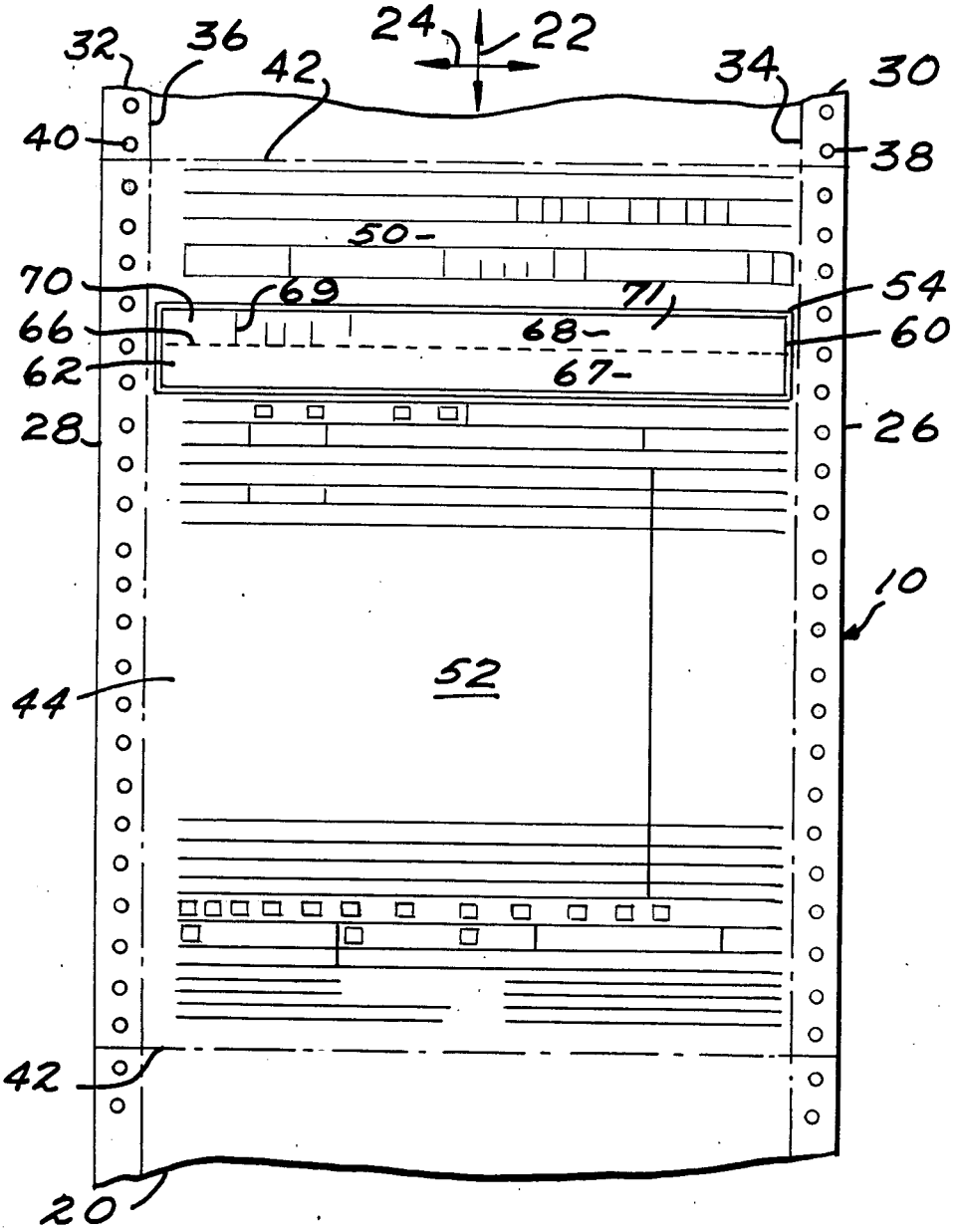
FIG. 1 is a top view of a portion of a continuous form which carries an identification band blank according to the invention.

Referring now to the drawings, FIG. 1 shows a continuous form assembly 10 which, for simplicity, is illustrated as a single web, but which, in practice, may be formed of a plurality of overlying webs with carbon paper therebetween or image transfer surfaces adapted to transfer an impression applied to the top web of the assembly to webs therebelow. However, for purposes of illustration, reference will be made only to a single web 20 which has a longitudinal extent along its direction of continuity 22, and a transverse extent along a transverse direction 24 perpendicular to the direction 22. Along transversely marginal, longitudinally extending (i.e., marginal) edges 26 and 28 of the assembly 10, web 20 has marginal feed strips 30, 32, respectively, defined by marginal perforation lines 34, 36, and marginal rows of spaced feed holes 38, 40, respectively. Spaced, transverse lines of perforations 42 divide the assembly into a plurality of separate sheets or panels 44 which may be individually separated from the remainder of the assembly, and from adjoining panels along the lines of perforation 42. For purposes of illustration, each such sheet or panel 44 may comprise a hospital admission form having an upper data receiving area 50, a lower data receiving area 52 and, between data receiving areas 50 and 52, a panel 54 coated with a conventional release material, which panel 54 is at least as large, and preferably slightly larger than an identification band blank 60 releasably secured thereon. The blank 60 is preferably formed from suitable non-irritating material such as that available under the trade mark "TYVEK".

Figure 4:
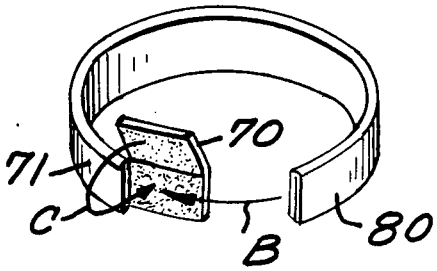
FIG. 4 is a perspective view of the identification band blank of FIG. 3 formed into a partial loop.

As viewed in FIG. 1, the upper surface 62 of blank 60 is adapted to have data applied thereto, whereas the bottom surface of the blank is coated with a permanent, pressure sensitive adhesive 64, not shown in FIG. 1, but partially visible in FIG. 4. The pressure sensitive adhesive 64 may be any one of a variety of adhesives well known in the trade, and which are adapted to produce a substantially permanent bond. However, the adhesive 64 adheres only slightly to the release surface of panel 54 so that the identification band blank 60 is retained on the panel 54 in normal circumstances, but may be readily removed or stripped from the panel 44 when desired, without significantly impairing the effectiveness of the pressure sensitive adhesive 64. In the relevant art, the identification band blank 60 is said to be "tipped on" the sheet or panel 44.

As will appear from FIG. 1, the identification band blank 60 is of elongated rectangular shape, and is provided with a centrally disposed longitudinally extending or axial line of weakness 66 which, as viewed in FIG. 1, separates the blank into a lower half 67 and an upper half 68 which upper half 68 is divided by separating slit 69 into a relatively short tab portion 70, and an elongated body portion 71.

In the illustrated embodiment, the upper half 68 of the identification band blank 60, as viewed in FIG. 1, is adapted to have data applied thereto over both the tab portion 70 and the body portion 71. It will of course be understood that data could as readily be applied to the lower half 67 of the blank 60, or that data could be applied to only one or other of the tab portion 70 or the body portion 71.

When used in the emergency or other admissions section of a hospital, for example, the endmost panel 44 of assembly 10 is completed by inserting, by means of a typewriter or other imprinting means, relevant data concerning the patient, including his or her identity and relevant medical history. At the same time, information respecting the patient's identity is applied to the upper half 68 of the identification band blank 60, and the completed panel 44 is separated from the remainder of the assembly. At the same time, the identification band blank 60 may be removed from the form simply by manually stripping it from the release panel 54.

Figure 2:
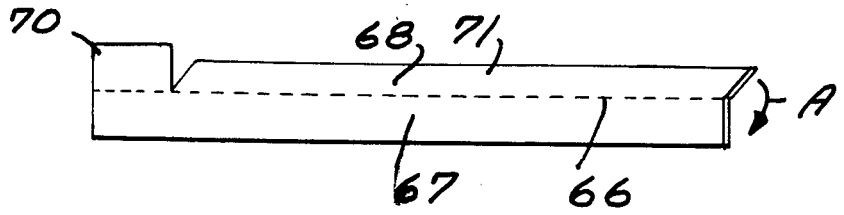
FIG. 2 is a perspective view of an identification band blank with a portion thereof folded about its longitudinal axis with respect to the remainder.
Figure 3:
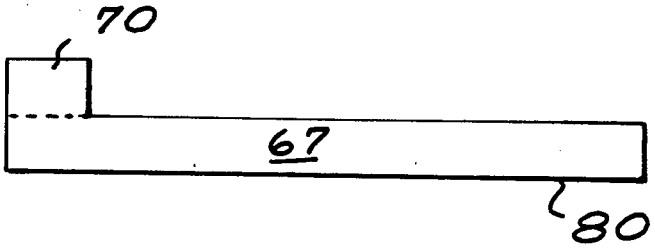
FIG. 3 is a frontal view of the identification band blank of FIG. 2 with a portion thereof completely folded upon itself.

As seen in FIG. 2, the body portion 71 of the removed blank 60 is folded back about the centrally disposed axial line of weakness 66 in the direction of arrow A, so that the adhesive coated surface of body portion 71 abuts, and is pressed against the adhesive coated surface of the lower half 67 of the blank 60 to form a relatively thin band portion 80 as seen in FIG. 3, with only the tab portion 70 of the original blank 60 remaining at full width. The free end of band portion 80 is then looped around in the direction of arrow B in FIG. 4, so that it overlies the remaining exposed adhesive surface 64 of the lower half 67, and is pressed there against to form a closed loop, whereupon tab portion 70 is folded in the direction of arrow C, so that its adhesive backed portion overlies said overlapping end portion, and is pressed thereto to form a sealed closed loop as illustrated in FIG. 5.

Figure 5:
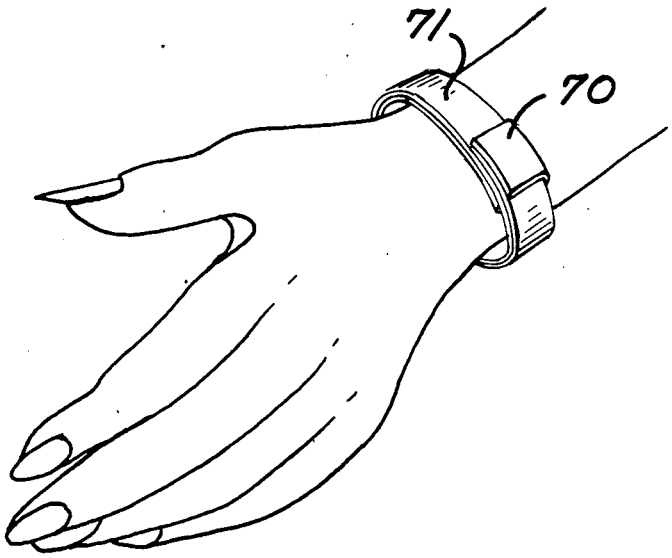
FIG. 5 is a perspective view of an identification band about the wrist of a wearer.

It will be apparent that the closed loop illustrated in FIG. 5 will normally be formed about the wrist or similar limb portion of a patient, and the loop is formed so that any data carried by the data receiving portion of the identification band blank will be clearly visible.

It will be apparent that, while a preferred embodiment of the invention has been described, and that while a particular use for the invention has been suggested, this is for illustrative purposes only, and the preferred embodiment and suggested use may be varied without departing from the scope of the invention.

What is claimed is:

1. An identification band blank comprising:

an elongated strip of material having side edges and a centrally disposed completely foldable line of weakness along a longitudinal axis extending entirely thereacross in order to separate said strip into an upper half and a lower half, said strip having a top surface adapted to receive data on at least a part thereof, and a bottom surface covered with a permanent pressure sensitive adhesive, and said strip also having means, extending from one side edge of said strip to said longitudinal axis, for separating one longitudinal half of said strip into a relatively short tab portion and a relatively long body portion, said short tab portion and said long body portion both being foldable about said line of weakness.

2. An identification band blank comprising: an elongated strip of material having side edges and a centrally disposed longitudinal axis, said strip having a top surface receiving data on at least a part thereof, and a bottom surface covered with a permanent pressure sensitive adhesive; and means extending from one side edge of said strip to said longitudinal axis for separating one longitudinal half of said strip into a relatively short tab portion and a relatively long body portion; said body portion foldable about said longitudinal axis so that the adhesive surface of said body portion overlies and is bondable to the adhesive surface of the other longitudinal half of the strip to form a band portion, wherein said band portion is bendable to bring its free end into overlapping relationship with the adhesive surface opposite said tab portion and is bondable thereto, and said tab portion is foldable about said longitudinal axis with its adhesive surface overlying and being bondable to said free end of the band portion to produce a closed loop with said data receiving surface.

3. An identification band blank according to claim 2, wherein said elongated strip comprises suitable non-irritating material and said side edges are parallel to each other and to said longitudinal axis.

4. An identification band blank according to claim 3, wherein said means extending from one side edge to said longitudinal axis is a line of weakness.

5. An identification band blank according to claim 3, wherein said means extending from one side edge to said longitudinal axis is a through slit.

6. An identification band blank according to claim 2, wherein said means extending from one side edge to said longitudinal axis is a line of weakness.

7. An identification band blank according to claim 2, wherein said means extending from one side edge to said longitudinal axis is a through slit.

8. A combination business form and identification band blank comprising:

a preprinted form including at least one sheet having a panel coated with an adhesive release surface thereon; and an identification band blank including:

an elongated strip of non-irritating material having parallel side edges and a centrally disposed longitudinal axis, said strip having a top surface for receiving data, and a bottom surface covered with a permanent pressure sensitive adhesive disposed on said panel; and means extending from one side edge of said strip to said longitudinal axis for separating one longitudinal half of said strip into a relatively short tab portion and a relatively long body portion;

said body portion being foldable about said longitudinal axis so that the adhesive surface of said body portion overlies and is bondable to the adhesive surface of the other longitudinal half of the strip to form a band portion;

wherein said band portion is bendable to bring its free end into overlapping relationship with the adhesive surface opposite said tab portion and is bondable thereto; and wherein said tab portion is foldable about said longitudinal axis with its adhesive surface overlying and being bondable to said free end of the hand portion to produce a closed loop with said data receiving surface outwardly disposed.

9. The combination of claim 8, wherein said means extending from one side edge to said longitudinal axis is a through slit.

* * * * *